US012338719B2

(12) United States Patent
Greci et al.

(10) Patent No.: US 12,338,719 B2
(45) Date of Patent: Jun. 24, 2025

(54) FLOW CONTROL SYSTEM FOR USE IN A SUBTERRANEAN WELL

(71) Applicant: Halliburton Energy Services, Inc., Houston, TX (US)

(72) Inventors: Stephen Michael Greci, Little Elm, TX (US); Ryan W. McChesney, Prosper, TX (US); Michael Linley Fripp, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/340,063

(22) Filed: Jun. 23, 2023

(65) Prior Publication Data

US 2024/0076968 A1 Mar. 7, 2024

Related U.S. Application Data

(60) Provisional application No. 63/374,613, filed on Sep. 6, 2022.

(51) Int. Cl.
*E21B 43/12* (2006.01)

(52) U.S. Cl.
CPC ..... *E21B 43/12* (2013.01)

(58) Field of Classification Search
CPC ..... E21B 43/08; E21B 43/12; E21B 43/32
See application file for complete search history.

(56) References Cited

U.S. PATENT DOCUMENTS 8,261,839 B2 9/2012 Fripp et al.
8,555,975 B2 * 10/2013 Dykstra ..... E21B 43/12 137/809
8,684,094 B2 4/2014 Greci
8,905,144 B2 12/2014 Dykstra et al.
2009/0226301 A1 * 9/2009 Priestman ..... F15C 1/02 137/810
2011/0297385 A1 * 12/2011 Dykstra ..... E21B 43/12 166/316
2012/0111577 A1 * 5/2012 Dykstra ..... E21B 43/12 166/373
2012/0292015 A1 11/2012 Schultz et al.
2014/0041731 A1 * 2/2014 Fripp ..... E21B 43/32 137/13

FOREIGN PATENT DOCUMENTS

WO 2009013509 A2 1/2009

OTHER PUBLICATIONS

International Search Report and Written Opinion dated Oct. 13, 2023 for PCT Patent Application No. PCT/US2023/026106 filed on Jun. 23, 2023.

* cited by examiner

*Primary Examiner* — Caroline N Butcher
(74) *Attorney, Agent, or Firm* — K&L Gates LLP

(57) ABSTRACT

A flow control system for use in controlling flow of a fluid composition in a subterranean well is disclosed. The flow control system includes a flow chamber that includes an inlet and an outlet oriented such that the fluid composition flows circuitously through the chamber, forming a vortex at least at the outlet. The flow control system further comprises at least one flow control structure shaped and positioned in the flow chamber such that a velocity of the circuitous flow is reduced and the vortex is eliminated or substantially reduced.

17 Claims, 5 Drawing Sheets

FLOW CONTROL SYSTEM FOR USE IN A SUBTERRANEAN WELL

BACKGROUND

This disclosure relates generally to equipment utilized and operations performed in conjunction with a subterranean well and, in an example described below, more particularly provides for constant flow in a subterranean well regardless of the properties of the production or injection fluids.

In a hydrocarbon injection well, it is many times beneficial to be able to regulate flow of fluids from a wellbore into an earth formation. Similarly, in an oil/fluid production well, it is many times beneficial to be able to regulate flow of fluids from the earth formation into the wellbore.

A variety of purposes may be served by such regulation, including prevention of water or gas coning, minimizing sand production, minimizing water and/or gas production, maximizing oil and/or gas production, balancing production among zones, reducing the pressure drop across the well, reducing erosion, etc.

It will be appreciated that advancements in the art of providing a constant fluid flow in a well would be desirable in the circumstances mentioned above, and such advancements would also be beneficial in a wide variety of other circumstances.

BRIEF DESCRIPTION OF THE DRAWINGS

Embodiments of the flow control system are described with reference to the following figures. The same or sequentially similar numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

Figure 1:
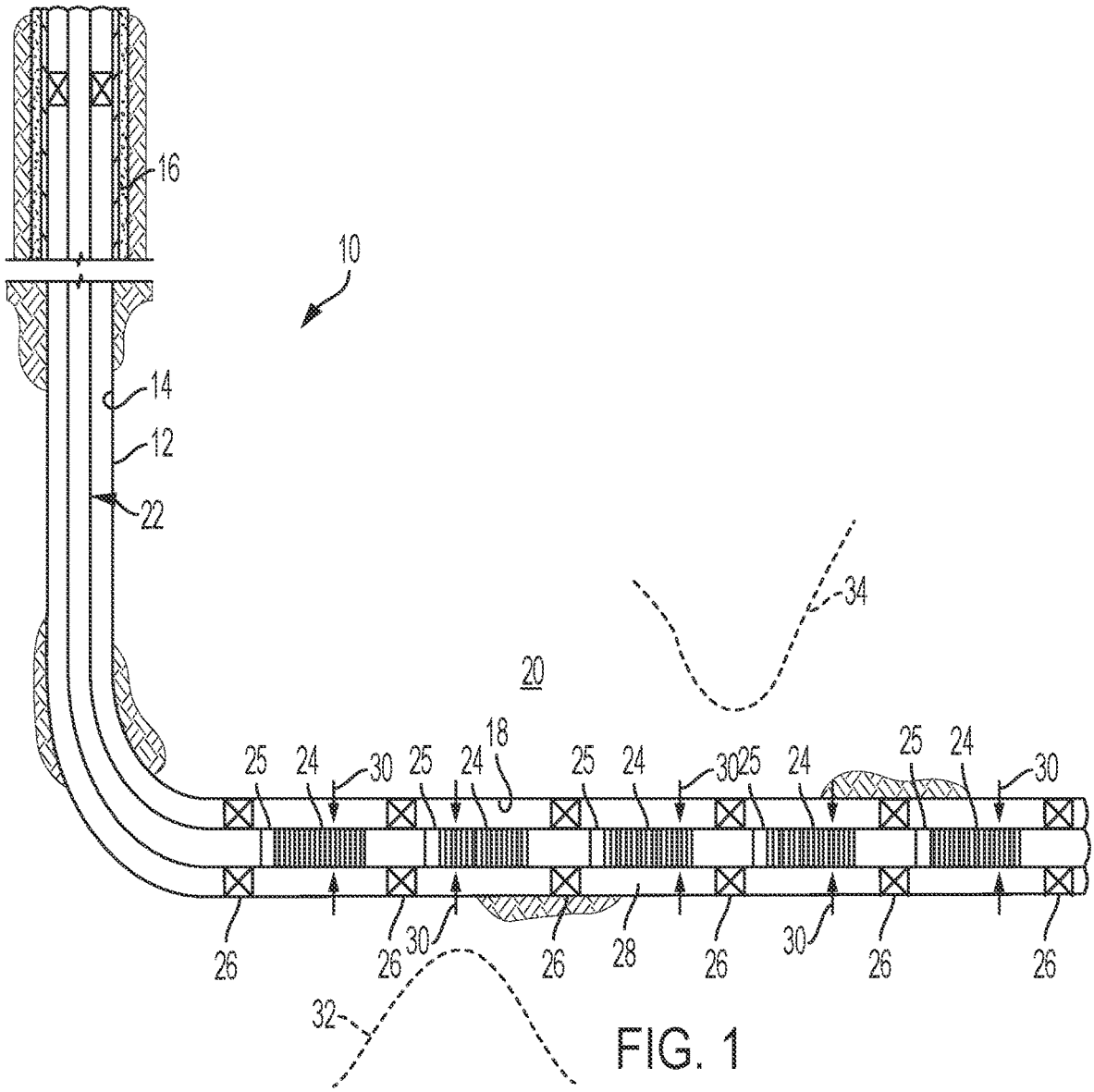
FIG. 1 is a schematic partially cross-sectional view of a well system which can embody principles of the present disclosure.

Representatively illustrated in FIG. 1 is a well system 10 which can embody principles of this disclosure. As depicted in FIG. 1, a wellbore 12 has a generally vertical uncased section 14 extending downwardly from casing 16, as well as a generally horizontal uncased section 18 extending through an earth formation 20.

A tubular string 22 (such as a production tubing string) is installed in the wellbore 12. Interconnected in the tubular string 22 are multiple well screens 24, flow control systems 25 and packers 26.

The packers 26 seal off an annulus 28 formed radially between the tubular string 22 and the wellbore section 18. In this manner, fluids 30 may be produced from multiple intervals or zones of the formation 20 via isolated portions of the annulus 28 between adjacent pairs of the packers 26.

Positioned between each adjacent pair of the packers 26, a well screen 24 and a flow control system 25 are interconnected in the tubular string 22. The well screen 24 filters the fluids 30 flowing into the tubular string 22 from the annulus 28. The flow control system 25 controls the flow of the fluids 30 into the tubular string 22, regardless of the characteristics of the fluids.

At this point, it should be noted that the well system 10 is illustrated in the drawings and is described herein as merely one example of a wide variety of well systems in which the principles of this disclosure can be utilized. It should be clearly understood that the principles of this disclosure are not limited at all to any of the details of the well system 10, or components thereof, depicted in the drawings or described herein.

For example, it is not necessary in keeping with the principles of this disclosure for the wellbore 12 to include a generally vertical wellbore section 14 or a generally horizontal wellbore section 18. It is not necessary for fluids 30 to be only produced from the formation 20 since, in other examples, fluids could be injected into a formation, fluids could be both injected into and produced from a formation, etc.

It is not necessary for one each of the well screen 24 and flow control system 25 to be positioned between each adjacent pair of the packers 26. It is not necessary for a single flow control system 25 to be used in conjunction with a single well screen 24. Any number, arrangement and/or combination of these components may be used.

It is not necessary for any flow control system 25 to be used with a well screen 24. For example, in injection operations, the injected fluid could be flowed through a flow control system 25, without also flowing through a well screen 24.

It is not necessary for the well screens 24, flow control systems 25, packers 26 or any other components of the tubular string 22 to be positioned in uncased sections 14, 18 of the wellbore 12. Any section of the wellbore 12 may be cased or uncased, and any portion of the tubular string 22 may be positioned in an uncased or cased section of the wellbore, in keeping with the principles of this disclosure.

It should be clearly understood, therefore, that this disclosure describes how to make and use certain examples, but the principles of the disclosure are not limited to any details of those examples. Instead, those principles can be applied to a variety of other examples using the knowledge obtained from this disclosure.

It will be appreciated by those skilled in the art that it would be beneficial to be able to regulate flow of the fluids 30 into the tubular string 22 from each zone of the formation 20, for example, to prevent water coning 32 or gas coning 34 in the formation. Other uses for flow regulation in a well include, but are not limited to, balancing production from (or injection into) multiple zones, minimizing production or injection of undesired fluids, maximizing production or injection of desired fluids, reducing erosion of the well, reducing corrosion within the well, etc.

Examples of the flow control systems described herein more fully below can provide these benefits by providing a constant fluid flow between the inlet and outlet portions of the flow control system to reduce the pressure drop and erosion potential within the well.

Whether a fluid is a desired or an undesired fluid depends on the purpose of the production or injection operation being conducted. For example, if it is desired to produce oil from a well, but not to produce water or gas, then oil is a desired fluid and water and gas are undesired fluids. If it is desired to produce gas from a well, but not to produce water or oil, the gas is a desired fluid, and water and oil are undesired fluids. If it is desired to inject steam into a formation, but not to inject water, then steam is a desired fluid and water is an undesired fluid.

Note that, at downhole temperatures and pressures, hydrocarbon gas can actually be completely or partially in liquid phase. Thus, it should be understood that when the term "gas" is used herein, supercritical, liquid and/or gaseous phases are included within the scope of that term.

Figure 2:
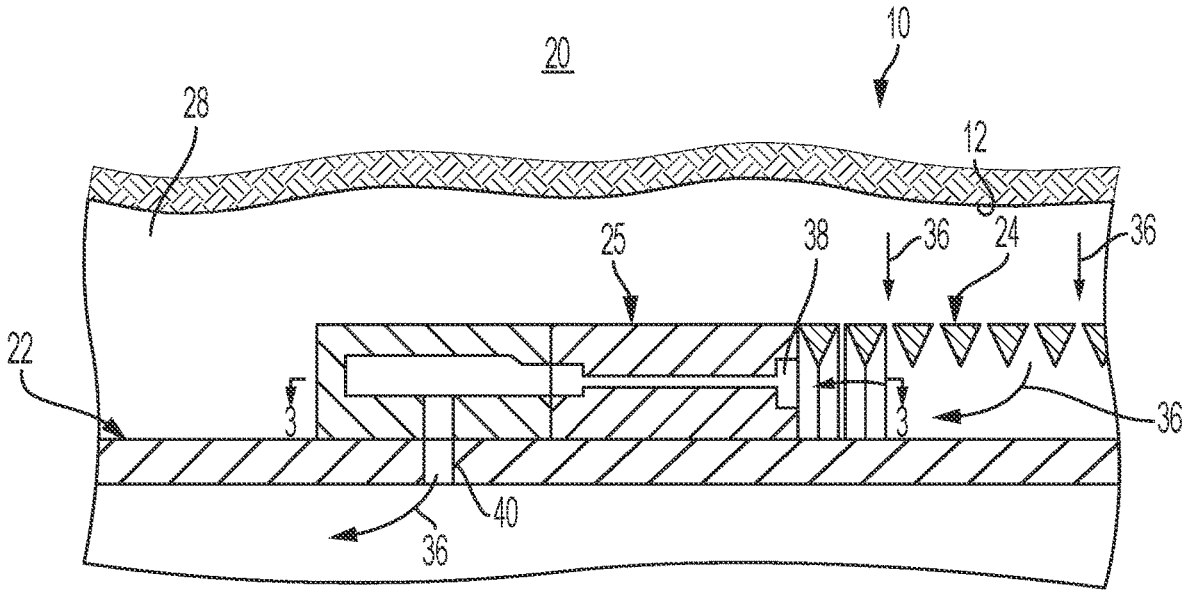
FIG. 2 is an enlarged scale schematic cross-sectional view of a well screen and a flow control system which may be used in the well system of FIG. 1.

Referring additionally now to FIG. 2, an enlarged scale cross-sectional view of one of the flow control systems 25 and a portion of one of the well screens 24 is representatively illustrated. In this example, a fluid composition 36 (which can include one or more fluids, such as oil and water, liquid water and steam, oil and gas, gas and water, oil, water and gas, etc.) flows into the well screen 24, is thereby filtered, and then flows into an inlet 38 of the flow control system 25.

A fluid composition can include one or more undesired or desired fluids. Both steam and water can be combined in a fluid composition. As another example, oil, water and/or gas can be combined in a fluid composition.

Flow of the fluid composition 36 through the flow control system 25 is resisted based on one or more characteristics (such as density, viscosity, velocity, etc.) of the fluid composition. The fluid composition 36 is then discharged from the flow control system 25 to an interior of the tubular string 22 via an outlet 40.

In other examples, the well screen 24 may not be used in conjunction with the flow control system 25 (e.g., in injection operations), the fluid composition 36 could flow in an opposite direction through the various elements of the well system 10 (e.g., in injection operations), a single flow control system could be used in conjunction with multiple well screens, multiple flow control systems could be used with one or more well screens, the fluid composition could be received from or discharged into regions of a well other than an annulus or a tubular string, the fluid composition could flow through the flow control system prior to flowing through the well screen, any other components could be interconnected upstream or downstream of the well screen and/or flow control system, etc. Thus, it will be appreciated that the principles of this disclosure are not limited at all to the details of the example depicted in FIG. 2 and described herein.

Although the well screen 24 depicted in FIG. 2 is of the type known to those skilled in the art as a wire-wrapped well screen, any other types or combinations of well screens (such as sintered, expanded, pre-packed, wire mesh, etc.) may be used in other examples. Additional components (such as shrouds, shunt tubes, lines, instrumentation, sensors, inflow control devices, etc.) may also be used, if desired.

The flow control system 25 is depicted in simplified form in FIG. 2, but in a example, the system can include various passages and devices for performing various functions, as described more fully below. In addition, the system 25 may at least partially extends circumferentially about the tubular string 22, or the system may be formed in a wall of a tubular structure interconnected as part of the tubular string.

In other examples, the system 25 may not extend circumferentially about a tubular string or be formed in a wall of a tubular structure. For example, the system 25 could be formed in a flat structure, etc. The system 25 could be in a separate housing that is attached to the tubular string 22, or it could be oriented so that the axis of the outlet 40 is parallel to the axis of the tubular string. The system 25 could be on a logging string or attached to a device that is not tubular in shape. Any orientation or configuration of the system 25 may be used in keeping with the principles of this disclosure.

Figure 3:
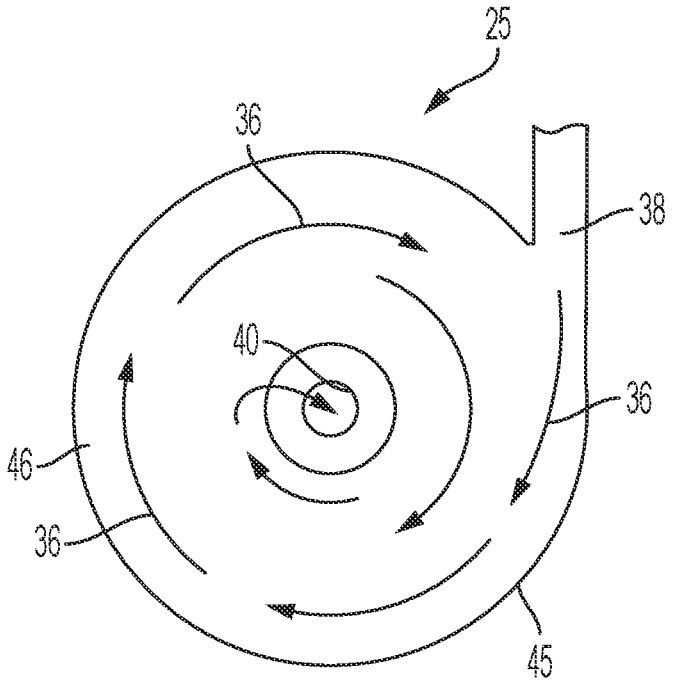
FIG. 3 is a schematic plan view of a configuration of a flow chamber of a flow control system having a single inlet and a single outlet.

Referring primarily to FIG. 3, a configuration of a flow chamber 46 of the flow control system 25 of FIG. 2 is illustrated. The flow chamber 46 of FIG. 3 comprises a single inlet 38 and a single outlet 40. The fluid composition 36 will flow circuitously about the chamber 46 prior to exiting via the outlet 40. Since the chamber 46 in this example has a cylindrical shape with a central outlet 40, and the fluid composition 36 spirals about the chamber 46, increasing in velocity as it nears the outlet, driven by a pressure differential from the inlet 38 to the outlet 40, the chamber may be referred to as a "vortex" chamber. Further, a non-cylindrical chamber such as a square or rectangular chamber that includes an inlet 38 that is perpendicular to an outlet 40, for example, will still produce circuitous flow, i.e., a vortex. It should be understood that the inlet 38 does not have to be perpendicular to the outlet 40 for the chamber 46 to produce circuitous flow, e.g., a vortex of the fluid composition 36. As such, other embodiments are envisioned where the inlet 38 is not perpendicular to the outlet 40. Moreover, it should be understood that if the inlet 38 were to point directly at the outlet 40 such that the fluid composition 36 flows directly toward the outlet 40 when it exits the inlet 38, circuitous flow, e.g., a vortex of the fluid composition 36 may still result. As such, other embodiments are envisioned where the inlet 38 points directly at the outlet 40 such that the fluid composition 36 flows directly toward the outlet 40, for example.

Figure 4:
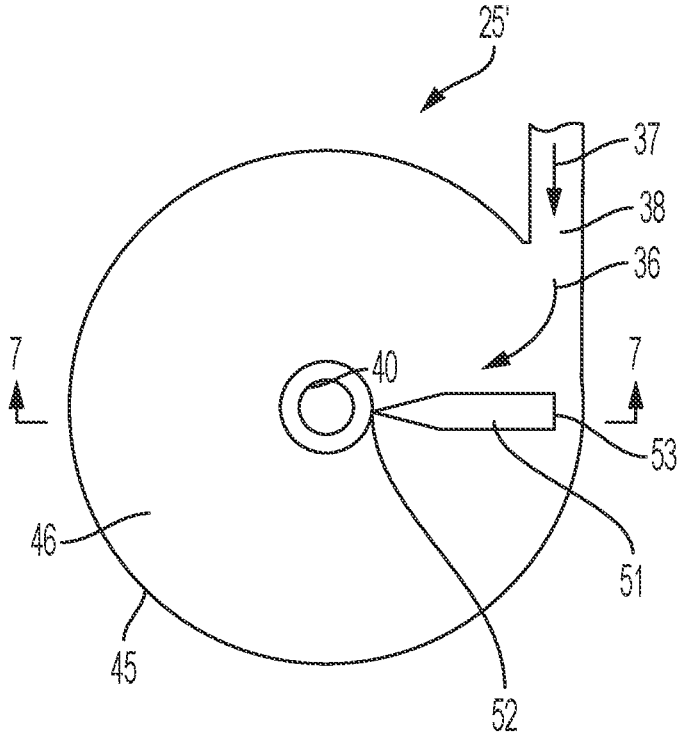
FIG. 4 is a schematic plan view of another configuration of a flow chamber of a flow control system having a single inlet, a single outlet, and a flow control structure.

Referring now to FIG. 4, another flow control system 25' is illustrated. The flow control system 25' comprises a chamber 46 having a single inlet 38 and a single outlet 40, similar to the flow control system 25 of FIG. 3. The flow control system 25' further comprises a protrusion, or a flow control structure 51, extending within the chamber 46. In the illustrated embodiment, the flow control structure 51 is oriented perpendicular to the incoming fluid composition 37 from the inlet 38 such that the incoming fluid composition 37 is directed toward the outlet 40. However, other embodiments are envisioned where the flow control structure 51 and the incoming fluid composition 37 are oriented at different angles relative to one another by modifying the relative positions of the flow control structure 51 and the inlet 38, for example. In the illustrated embodiment the flow structure 51 is a one piece structure with flat edges. However, other embodiments are envisioned where the flow structure 51 is discontinuous, has curved edges, has rounded edges, has bends or joints, and/or is wavy, for example. In any event, the flow control structure 51 disrupts the circuitous flow that would otherwise be produced by the chamber 46 as illustrated in FIG. 3. To do so, the flow control structure 51 is positioned within the chamber 46 such that the velocity of the circuitous flow is reduced and the vortex is eliminated or substantially reduced. In other words, the vortex created by the fluid composition in the chamber 46 of FIG. 3 is eliminated and/or substantially reduced. In the illustrated embodiment, the flow control structure 51 is oriented perpendicular to the inlet 38 at a radial position close to the inlet 38. However, other embodiments are envisioned where the structure 51 is positioned at any radial position about the outlet 40, for example. The flow control structure 51 will reduce, disrupt, and/or eliminate the turbulent flow in the chamber 46 no matter its radial position about the central outlet 40. The flow control structure 51 reduces, disrupts, and/or eliminates the turbulent flow regardless of the makeup of the fluid composition such as including one or more fluids, such as oil and water, liquid water and steam, oil and gas, gas and water, oil, water and gas, etc. Further, even though flow of the fluid composition 36 through the flow control system 25 is resisted based on one or more characteristics (such as density, viscosity, velocity, etc.) of the fluid composition, the flow control structure 51 substantially reduces, disrupts, and/or eliminates the turbulent flow in the chamber 46 regardless of the characteristics of the fluid composition.

In the illustrated embodiment, the flow control structure 51 is positioned adjacent to the outlet 40 and extends toward an interior sidewall 45 of the chamber 46 but does not extend all the way to the sidewall 45. However, other embodiments are envisioned where the flow control structure 51 extends all the way to the sidewall 45, for example. In the illustrated embodiment, an inside end 52 of the flow control structure 51 is flush with the outlet 40. However, other embodiments are envisioned where the flow control structure 51 extends laterally over a portion of the outlet 40, for example. Further still, other embodiments are envisioned where there is a lateral gap between the outlet 40 and the inside end 52 of the flow control structure 51. Further, in the illustrated embodiment, the inside end 52 of the flow control structure 51 converges to a point. However, other embodiments are envisioned where the inside end 52, and/or an outside end 53 are rounded, chamfered, filleted, etc., for example.

Figure 5:
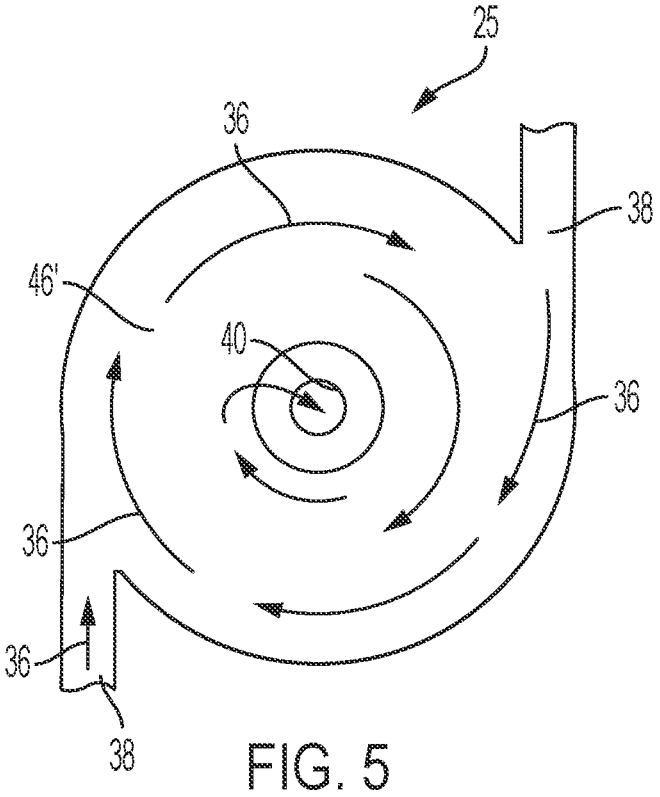
FIG. 5 is a schematic plan view of a configuration of a flow chamber of a flow control system having multiple inlets and a single outlet.

Referring now to FIG. 5, a configuration of another flow chamber 46' of the flow control system 25 is illustrated. The flow chamber 46' illustrated in FIG. 5 has multiple inlets 38 and a single outlet 40. The fluid composition 36 will flow circuitously about the chamber 46' prior to exiting via the outlet 40. Since the chamber 46' in this example has a cylindrical shape with a central outlet 40, and the fluid composition 36 spirals about the chamber, increasing in velocity as it nears the outlet, driven by a pressure differential from the inlets 38 to the outlet 40, the chamber may be referred to as a "vortex" chamber. Further, a non-cylindrical chamber such as a square or rectangular chamber including multiple inlets 38 that are perpendicular to an outlet 40, for example, will still produce circuitous flow, i.e., a vortex chamber. As discussed above, with regard to the flow chamber 46, the inlets 38 and outlet 40 of the flow chamber 46' do not have to be perpendicular to one another to produce a vortex chamber. As such, other embodiments are envisioned where the inlets 38 and the outlet 40 are not perpendicular to one another.

Figure 6:
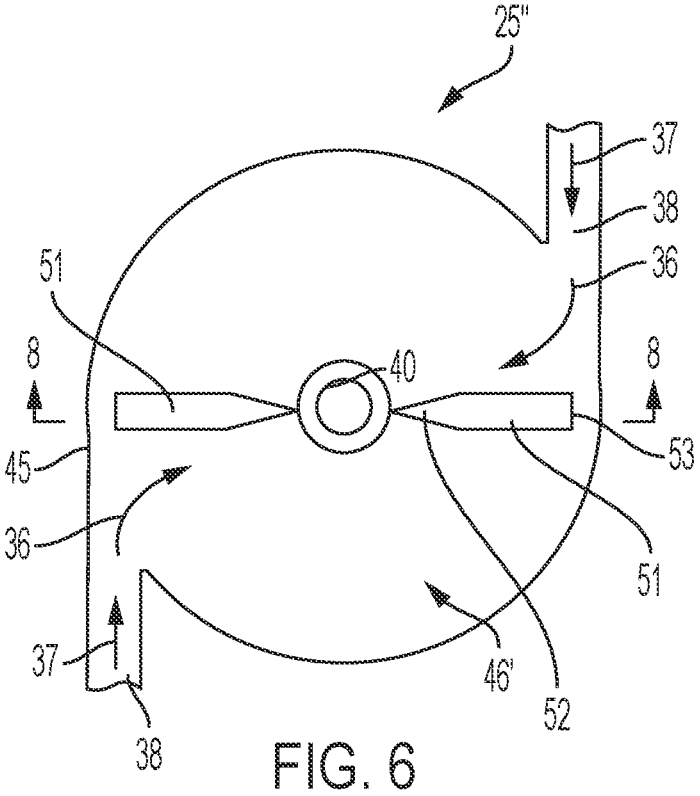
FIG. 6 is a schematic plan view of a configuration of a flow chamber of a flow control system having multiple inlets, a single outlet, and a plurality of flow control structures.

Referring now to FIG. 6, another flow control system 25" is illustrated. The flow control system 25" comprises the chamber 46' having multiple inlets 38 and a single outlet 40, similar to the flow control system 25 of FIG. 5. The flow control system 25" further comprises a plurality of protrusions, or flow control structures 51 extending within the chamber 46 on opposite sides of the outlet 40. In the illustrated embodiment, the flow control structures 51 are oriented perpendicular to the incoming fluid composition 37 from the inlets 38 such that the incoming fluid composition 37 is directed toward the outlet 40. However, other embodiments are envisioned where the flow control structures 51 and the incoming fluid composition 37 are oriented at different angles relative to one another by modifying the relative positions of the flow control structures 51 and the inlet 38, for example. In the illustrated embodiment each of the flow structures 51 are a one piece structure with flat edges. However, other embodiments are envisioned where the flow structure 51 is discontinuous, has curved edges, has rounded edges, has bends or joints, and/or is wavy, for example. In any event, the flow control structures 51 disrupt the circuitous flow that would otherwise be produced by the chamber 46' as illustrated in FIG. 5. To do so, the flow control structures 51 are positioned within the chamber 46' such that the velocity of the circuitous flow is reduced and the vortex is eliminated or substantially reduced. In other words, the vortex created by the fluid composition in the chamber 46' of FIG. 5 is eliminated and/or substantially reduced. The flow control structures 51 reduce, disrupt, and/or eliminate the turbulent flow regardless of the makeup of the fluid composition such as including one or more fluids, such as oil and water, liquid water and steam, oil and gas, gas and water, oil, water and gas, etc. Further, even though flow of the fluid composition 36 through the flow control system 25" is resisted based on one or more characteristics (such as density, viscosity, velocity, etc.) of the fluid composition, the flow control structures 51 substantially reduce, disrupt, and/or eliminate the turbulent flow in the chamber 46' regardless of the characteristics of the fluid composition.

In the illustrated embodiment, the flow control structures 51 are oriented perpendicular to the inlets 38 and intermediate the inlets 38. However, other embodiments are envisioned where the structures 51 are positioned at any radial position about the outlet 40 on either side of the outlet 40, for example. Other embodiments are envisioned wherein the flow control structures 51 are not mirror images of each other about the outlet 40. In any event, the flow control structures 51 will reduce, disrupt, and/or eliminate the turbulent flow in the chamber 46' no matter their radial positions about the central outlet 40.

In the illustrated embodiment, the flow control structures 51 are positioned adjacent to the outlet 40 and extend toward the sidewall 45 of the chamber 46' but do not extend all the way to the sidewall 45. However, other embodiments are envisioned where both of the flow control structures 51 extend all the way to the sidewall 45, for example. Further still, other embodiments are envisioned where only one structure 51 on one side of the outlet 40 extends all the way to the sidewall 45, for example. In the illustrated embodiment, an inside end 52 of the flow control structures 51 are flush with the outlet 40. However, other embodiments are envisioned where the flow control structures 51 extend over a portion of the outlet 40, for example. Further still, other embodiments are envisioned where there is a lateral gap between the outlet 40 and an inside end 52 of the flow control structures 51. Further, in the illustrated embodiment, the inside end 52 of each of the flow control structures 51 converges to a point. However, other embodiments are envisioned where the inside end 52, and/or an outside end 53 are rounded, chamfered, filleted, etc., for example.

Figure 7:
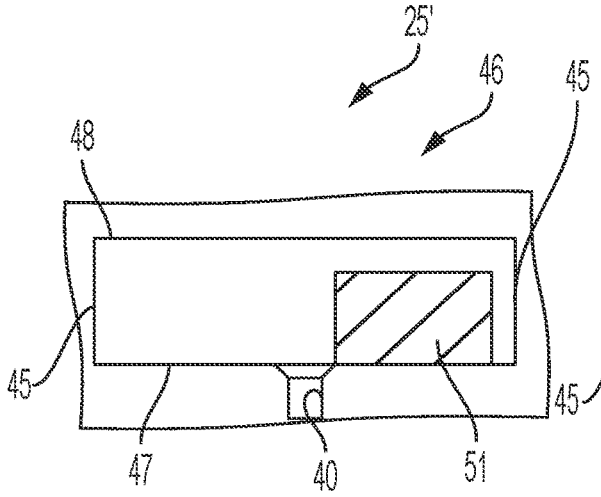
FIG. 7 is a schematic cross-sectional view of the flow chamber of FIG. 4 taken along line 7-7 of FIG. 4.
Figure 8:
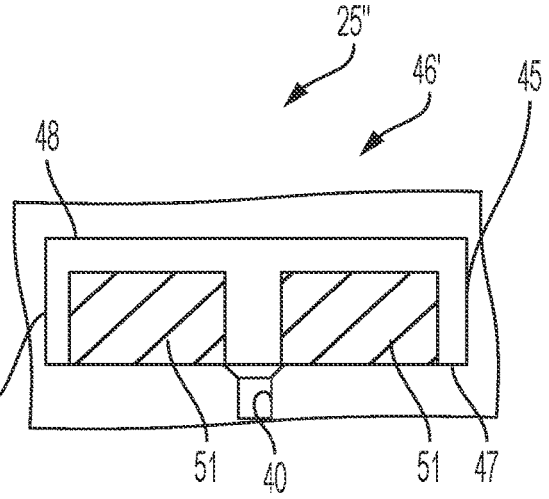
FIG. 8 is a schematic cross-sectional view of the flow chamber of FIG. 6 taken along line 8-8 of FIG. 6.

Referring primarily to FIG. 7, the chamber 46 comprises a bottom wall 47 and a top wall 48 opposite the bottom wall. The walls 47, 48 extend between the sidewall 45 of the chamber 46. FIG. 7 further illustrates the flow control structure 51 extending from the bottom wall 47 toward the top wall 48 but not all of the way to the top wall 48. However, other embodiments are envisioned where the structure 51 extends completely between the top and bottom walls 47, 48, for example. Similarly, FIG. 8 illustrates the structures 51 extending part of the way from the bottom wall 47 to the top wall 48 of the chamber 46'. However, other embodiments are envisioned where the structure 51 extends completely between the top and bottom walls 47,48, for example.

Figure 9:
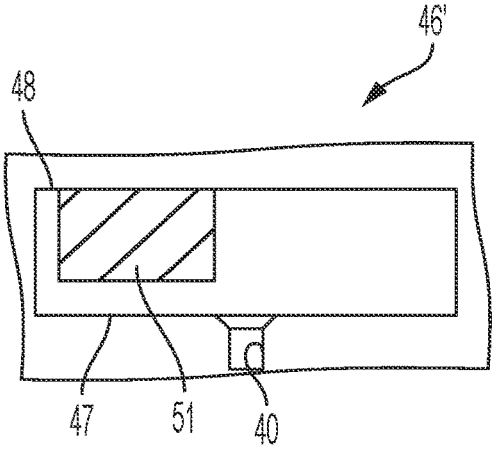
FIG. 9 is a schematic cross-sectional view of another flow chamber including a flow control structure protruding from the opposite side of the flow chamber cavity.
Figure 10:
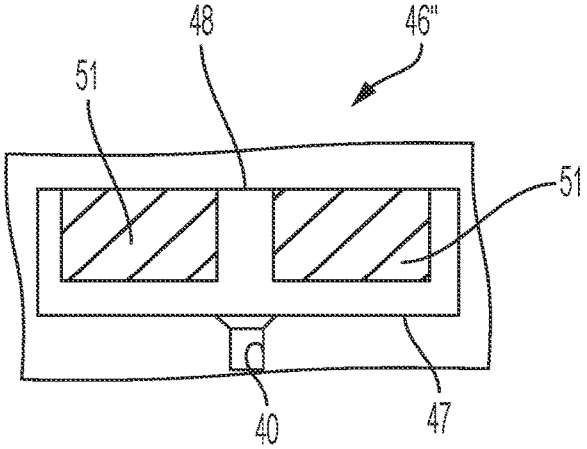
FIG. 10 is a schematic cross-sectional view of another flow chamber including multiple flow control structures protruding from the opposite side of the flow chamber cavity.

Referring primarily to FIGS. 9 and 10, alternative embodiments of the flow control structures 51 within chambers 46' and 46" are illustrated. Specifically, in FIG. 9, the flow control structure 51 extends downward from the top wall 48 toward the bottom wall 47 but not all of the way to the bottom wall 47. However, other embodiments are envisioned where the structure 51 extends completely between the top and bottom walls 47, 48, for example. Further, FIG. 10 illustrates multiple flow control structures extending downward from the top wall 48 toward the bottom wall 47 but not all of the way to the bottom wall 47. However, other embodiments are envisioned where the structures 51 extends completely between the top and bottom walls 47, 48, for example.

Further to the above, other embodiments are envisioned where the structure(s) 51 extends from the sidewall 45 toward the outlet 40 intermediate the bottom wall 47 and the top wall 48 of the chambers 46', 46", for example. Other embodiments are envisioned where one or more flow control structures are bolted to the flow control system 25', 25" such that the flow control structures float above the outlet 40 intermediate the walls 47, 48 of the chamber.

In the illustrated embodiments, the flow chambers 46, 46' are round or circular in nature, thus promoting circular flow of the fluids 36 which is then broken down by the flow control structures 51, for example. However, other embodiments are envisioned where the flow chamber(s) are rectangular or square. The flow control structures 51 described herein act to reduce and/or prevent turbulent flow (i.e., a vortex) within the flow chamber even if the flow chamber is rectangular or square.

Examples of the above embodiments include:

Example 1 is a flow control system for use in controlling flow of a fluid composition in a subterranean well, the flow control system comprising: a flow chamber comprising an inlet and an outlet oriented such that the fluid composition flows circuitously through the chamber, forming a vortex at least at the outlet; and at least one flow control structure shaped and positioned in the flow chamber such that a velocity of the circuitous flow is reduced and the vortex is eliminated or substantially reduced.

In Example 2, the embodiments of any preceding paragraph or combination thereof further include wherein a portion of the at least one flow control structure is located adjacent to or flush with the outlet.

In Example 3, the embodiments of any preceding paragraph or combination thereof further include wherein an inside end of the at least one flow control structure oriented toward the outlet converges to a point.

In Example 4, the embodiments of any preceding paragraph or combination thereof further include wherein the flow control structure comprises at least one of curved edges, rounded edges, bends, joints, or a wavy profile.

In Example 5, the embodiments of any preceding paragraph or combination thereof further include wherein the flow control structure comprises either a one piece structure or a discontinuous structure.

In Example 6, the embodiments of any preceding paragraph or combination thereof further include multiple flow control structures.

In Example 7, the embodiments of any preceding paragraph or combination thereof further include wherein the flow chamber further comprises an interior sidewall around the flow chamber with a bottom wall and a top wall extending across the flow chamber and wherein: the flow control structure extends from either the bottom wall or the top wall toward but not all the way to the other of either the top wall or the bottom wall; or the flow control structure extends completely between the top wall and the bottom wall.

In Example 8, the embodiments of any preceding paragraph or combination thereof further include wherein the flow control system is installable in or to a tubular string downhole in the subterranean well and is configured to control the flow of fluid composition into the tubular string.

Example 9 is a method of controlling flow of a fluid composition in a subterranean well through a subterranean formation, comprising: locating a tubular string downhole in the subterranean well, the tubular string comprising a flow control system; flowing the fluid composition from the subterranean formation into a flow chamber of the flow control system through an inlet so as to induce circuitous flow within the flow chamber; flowing the fluid composition out of the flow control system and into the tubular string through an outlet of the flow control system, the flow out of the flow control system forming a vortex at least at the outlet; and disrupting the circuitous flow with at least one flow control structure in the flow chamber to reduce the velocity of the circuitous flow and eliminate or substantially reduce the vortex.

In Example 10, the embodiments of any preceding paragraph or combination thereof further include wherein a portion of the at least one flow control structure is located adjacent to or flush with the outlet.

In Example 11, the embodiments of any preceding paragraph or combination thereof further include wherein an inside end of the at least one flow control structure oriented toward the outlet converges to a point.

In Example 12, the embodiments of any preceding paragraph or combination thereof further include wherein the flow control structure comprises at least one of curved edges, rounded edges, bends, joints, or a wavy profile.

In Example 13, the embodiments of any preceding paragraph or combination thereof further include wherein the flow control structure comprises either a one piece structure or a discontinuous structure.

In Example 14, the embodiments of any preceding paragraph or combination thereof further include the tubular string comprising multiple flow control systems.

In Example 15, the embodiments of any preceding paragraph or combination thereof further include wherein the flow control system further comprises multiple flow control structures.

Example 16 is a production system for producing at least a portion of a fluid composition from a subterranean formation, the production system locatable in a subterranean well extending through the formation, the production system comprising: a tubular string locatable downhole in the subterranean well and comprising a flow control system functional to control flow of the fluid composition into the tubular string, wherein the flow control system comprises: a flow chamber comprising an inlet and an outlet oriented such that the fluid composition flows circuitously through the chamber, forming a vortex at least at the outlet; and at least one flow control structure shaped and positioned in the flow chamber such that a velocity of the circuitous flow is reduced and the vortex is eliminated or substantially reduced.

In Example 17, the embodiments of any preceding paragraph or combination thereof further include wherein a portion of the at least one flow control structure is located adjacent to or flush with the outlet.

In Example 18, the embodiments of any preceding paragraph or combination thereof further include wherein an inside end of the at least one flow control structure oriented toward the outlet converges to a point.

In Example 19, the embodiments of any preceding paragraph or combination thereof further include wherein the flow control system comprises multiple flow control structures.

In Example 20, the embodiments of any preceding paragraph or combination thereof further include wherein the tubular string comprises multiple flow control systems spaced along the tubular string.

Certain terms are used throughout the description and claims to refer to particular features or components. As one skilled in the art will appreciate, different persons may refer to the same feature or component by different names. This document does not intend to distinguish between components or features that differ in name but not function.

While descriptions herein may relate to "comprising" various components or steps, the descriptions can also "consist essentially of" or "consist of" the various components and steps.

Unless otherwise indicated, all numbers expressing quantities are to be understood as being modified in all instances by the term "about" or "approximately". Accordingly, unless indicated to the contrary, the numerical parameters are approximations that may vary depending upon the desired properties of the present disclosure. As used herein, "about", "approximately", "substantially", and "significantly" will be understood by persons of ordinary skill in the art and will vary to some extent on the context in which they are used. If there are uses of the term which are not clear to persons of ordinary skill in the art given the context in which it is used, "about" and "approximately" will mean plus or minus 10% of the particular term and "substantially" and "significantly" will mean plus or minus 5% of the particular term.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A flow control system for use in controlling flow of a fluid composition in a subterranean well, the flow control system comprising:

a flow chamber comprising an inlet and an outlet oriented such that the fluid composition flows circuitously through the flow chamber; and at least one flow control structure shaped and positioned in the flow chamber such that a velocity of the circuitous flow is reduced and formation of a vortex at the outlet is eliminated or substantially reduced, wherein an inside end of the at least one flow control structure oriented toward the outlet converges to a point.

2. The system of claim 1, wherein a portion of the at least one flow control structure is located adjacent to or flush with the outlet.

3. The system of claim 1, wherein the flow control structure comprises at least one of curved edges, rounded edges, bends, joints, or a wavy profile.

4. The system of claim 1, wherein the flow control structure comprises either a one piece structure or a discontinuous structure.

5. The system of claim 1, further comprising multiple flow control structures.

6. The system of claim 1 wherein the flow chamber further comprises an interior sidewall around the flow chamber with a bottom wall and a top wall extending across the flow chamber and wherein:

the flow control structure extends from either the bottom wall or the top wall toward but not all the way to the other of either the top wall or the bottom wall; or the flow control structure extends completely between the top wall and the bottom wall.

7. The system of claim 1, wherein the flow control system is installable in or to a tubular string downhole in the subterranean well and is configured to control the flow of the fluid composition into the tubular string.

8. A method of controlling flow of a fluid composition in a subterranean well through a subterranean formation, comprising:

locating a tubular string downhole in the subterranean well, the tubular string comprising a flow control system;

flowing the fluid composition from the subterranean formation into a flow chamber of the flow control system through an inlet so as to induce circuitous flow within the flow chamber;

flowing the fluid composition out of the flow control system and into the tubular string through an outlet of the flow control system; and disrupting the circuitous flow with at least one flow control structure in the flow chamber to reduce a velocity of the circuitous flow and eliminate or substantially reduce formation of a vortex at the outlet, wherein an inside end of the at least one flow control structure oriented toward the outlet converges to a point.

9. The method of claim 8, wherein a portion of the at least one flow control structure is located adjacent to or flush with the outlet.

10. The method of claim 8, wherein the flow control structure comprises at least one of curved edges, rounded edges, bends, joints, or a wavy profile.

11. The method of claim 8, wherein the flow control structure comprises either a one piece structure or a discontinuous structure.

12. The method of claim 8, wherein the flow control system further comprises multiple flow control structures.

13. The method of claim 8, wherein the tubular string further comprises multiple flow control systems spaced along the tubular string.

14. A production system for producing at least a portion of a fluid composition from a subterranean formation, the production system locatable in a subterranean well extending through the formation, the production system comprising:

a tubular string locatable downhole in the subterranean well and comprising a flow control system functional to control flow of the fluid composition into the tubular string, wherein the flow control system comprises:

a flow chamber comprising an inlet and an outlet oriented such that the fluid composition flows circuitously through the flow chamber; and at least one flow control structure shaped and positioned in the flow chamber such that a velocity of the circuitous flow is reduced and formation of a vortex at the outlet is eliminated or substantially reduced, wherein an inside end of the at least one flow control structure oriented toward the outlet converges to a point.

15. The system of claim 14, wherein a portion of the at least one flow control structure is located adjacent to or flush with the outlet.

16. The system of claim 14, wherein the flow control system comprises multiple flow control structures.

17. The system of claim 14, wherein the tubular string comprises multiple flow control systems spaced along the tubular string.

* * * * *